US008575850B2

(12) United States Patent
Peng

(10) Patent No.: US 8,575,850 B2
(45) Date of Patent: Nov. 5, 2013

(54) SYSTEM AND METHOD FOR SUPPLYING CONSTANT POWER TO LUMINUOUS LOADS WITH POWER FACTOR CORRECTION

(75) Inventor: Chunghang Peng, Walnut, CA (US)

(73) Assignee: Ace Power International, Inc. (TW)

( * ) Notice: Subject to any disclaimer, the term of this patent is extended or adjusted under 35 U.S.C. 154(b) by 168 days.

(21) Appl. No.: 13/296,127

(22) Filed: Nov. 14, 2011

(65) Prior Publication Data

US 2013/0119869 A1 May 16, 2013

(51) Int. Cl.
*H05B 37/02* (2006.01)
*H05B 39/04* (2006.01)
*H05B 41/36* (2006.01)

(52) U.S. Cl.
USPC ..... 315/219; 315/246; 315/274; 315/276; 315/279

(58) Field of Classification Search
None
See application file for complete search history.

(56) References Cited

U.S. PATENT DOCUMENTS 8,242,766 B2 * 8/2012 Gaknoki et al. ..... 323/300
2010/0026208 A1 * 2/2010 Shteynberg et al. ..... 315/297

* cited by examiner

*Primary Examiner* — Anh Tran
(74) *Attorney, Agent, or Firm* — Fountain Law Group, Inc.; George L. Fountain

(57) ABSTRACT

An apparatus is disclosed for supplying power to a luminous load. The apparatus includes a transformer having a primary winding, and a control circuit adapted to generate an alternating current through the primary winding to develop an alternating voltage. The alternating current is based on a first signal derived from the input voltage, a second signal derived from the current, and a third signal varying substantially in-phase with the input voltage. The first and second signals are used to regulate the power delivered to the load, and the third signal is used to improve the power factor. A load interface circuit is provided to generate an output voltage for the luminous load based on the alternating voltage from the transformer. An over-temperature sensor may be provided to cause a reduction in power to the load when the ambient temperature exceeds a threshold.

24 Claims, 6 Drawing Sheets

SYSTEM AND METHOD FOR SUPPLYING CONSTANT POWER TO LUMINUOUS LOADS WITH POWER FACTOR CORRECTION

FIELD

This invention relates generally to supplying power to luminous loads, and in particular, to a system and method for supplying substantially constant power to a luminous load. The system and method includes a power factor correction circuit to improve the power factor associated with supplying power to the luminous load. Additionally, the system and method includes an over temperature circuit to reduce power to the luminous load if the ambient or environment temperature exceeds a threshold.

BACKGROUND

Light fixtures that use light emitting diode (LED) technology for illumination are gaining in popularity. These fixtures are now employed more frequently in commercial, residential and public settings. One reason why LED-based light fixtures are becoming popular is that they generally have longer operational life and operate at much higher power efficiency. For example, LED-based light fixtures typically have an operational life of around 50 to 100 thousand hours, whereas, incandescent-based light fixtures typically have an operational life of only one to two thousand hours. Additionally, LED-based light fixtures typically have a light efficacy that is 5 to 10 times that of an incandescent light fixture.

Driving or supplying power to LED-based light fixtures, however, may need more consideration to ensure substantially constant illumination. In the past, LED-based light fixtures have been driven by constant output voltage ballasts or constant output current ballasts. However, these devices generally do not provide constant power to LED-based loads, and thus, cannot ensure constant illumination of the luminous loads.

Taking, as an example, a constant output voltage ballast, it typically employs output voltage feedback to ensure that the voltage across an LED-based load is substantially constant. However, the junction voltage of LED devices decreases as environment temperature increases. As a consequence, the current, as well as the power, supplied to the LED load increases with a rise in temperature. As the current increases, this, in turn, may create more heat, which results in even higher current delivered to the load. This, in effect, may result in a thermal runaway, which may eventually lead to a burn out of the LED-based load.

In the case of a constant output current ballast, it typically employs output current feedback to ensure that the current through the LED-based load is substantially constant. However, as discussed above, the junction voltage of LED devices decreases as environment temperature increases. This has the consequence of the output voltage, as well as the power, decreasing with a rise in temperature. In this case, the LED light output will decrease with rising temperature, which may be undesirable for many applications.

Thus, a ballast that regulates both the voltage and current for a luminous load to ensure substantially constant power delivered to the load is desirable. Other desirable attributes for such a ballast is improving the power factor (PF) associated with supplying power to the luminous load, and providing protection to the associated circuit and the load in case the environment temperature gets too high.

SUMMARY

An aspect of the invention relates to an apparatus for supplying power to a luminous load. The apparatus includes a transformer having a primary winding adapted to receive an input voltage, and a control circuit adapted to generate an alternating current through the primary winding. The alternating current is based on a first signal derived from the input voltage, a second signal derived from the current, and a third signal varying substantially in-phase with the input voltage. The first and second signals are used to regulate the power delivered to the load, and the third signal is used to improve the power factor associated with delivering the power to the load. The transformer is adapted to develop an alternating voltage across the primary winding based on the alternating current. The apparatus further includes a load interface circuit adapted to generate an output voltage for the luminous load based on the alternating voltage. An over-temperature sensor may be provided to cause the control circuit to reduce power to the load in case the ambient temperature exceeds a threshold.

Other aspects, advantages and novel features of the present invention will become apparent from the following detailed description of the invention when considered in conjunction with the accompanying drawings.

DETAILED DESCRIPTION OF THE EXEMPLARY EMBODIMENTS

Figure 1:
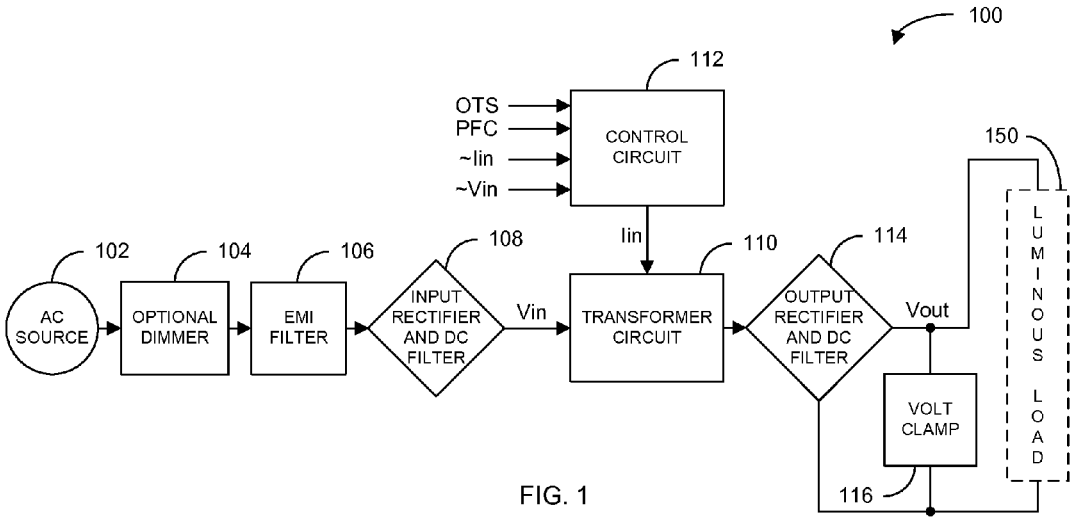
FIG. 1 illustrates a block diagram of an exemplary system for supplying substantially constant power to a luminous load in accordance with an aspect of the disclosure.

FIG. 1 illustrates a block diagram of an exemplary system 100 for supplying substantially constant power to a luminous load 150 in accordance with an aspect of the disclosure. The system 100 may be an example of a lighting system for a residential, commercial or government application. The system 100 comprises a utility alternating current (ac) source 102 (e.g., 60 Hz, 110-120 Volt line; 50 Hz, 220-240 Volt line; etc.), an optional dimmer 104 (e.g., a phase control dimmer circuit), an electromagnetic interference (EMI) filter 106, an input rectifier and direct current (dc) filter 108, a transformer circuit 110, a control circuit 112, an output rectifier and DC filter 114, and a voltage clamp 116. As discussed above, the system 100 supplies substantially constant power to a luminous load 150, which could be an LED-based, incandescent-based, fluorescent-based, or other type of luminous load.

The ac source 102 supplies power in the form of an alternating voltage (ac) (e.g., a substantially sinusoidal voltage) having defined or standardized parameters, such as the North American standard of 60 Hz, 110-120 Volt or the European standard of 50 Hz, 220-240 Volt. The optional dimmer 104 may be a phase-control type dimmer circuit, which suppresses or cut-outs a portion of the ac voltage based on a user input device (e.g., a dimming knob) for the purpose of controlling the illumination or brightness of the luminous load 150. The EMI filter 106 reduces extraneous signal interference and noise that may be present on the ac voltage line. The input rectifier and DC filter 108 rectifies and further filters the ac voltage from the EMI filter 106 in order to generate an input dc voltage Vin for the transformer circuit 110.

The control circuit 112 controls or modulates the current through the transformer circuit 110 in response to various parameters. For instance, two of the parameters have to do with the amount of power being delivered to the luminous load 150. These two parameters are: (1) a voltage ~Vin that is derived from the input voltage to the transformer circuit 110, and (2) a current ~Iin that is derived from a current flowing through a winding of the transformer circuit 110. The control circuit 112 is adapted to control the current through the input winding of the transformer circuit 110 in order to control, regulate, or maintain substantially constant the power delivered to the luminous load 150. The control circuit 112 may employ pulse width modulation at a substantially constant frequency to regulate the power delivered to the luminous load 150. More specifically, the control circuit 112 is adapted to maintain the power delivered to the luminous load 150 substantially constant given a defined range of the input voltage Vin to the transformer circuit 110 and a defined temperature range.

The control circuit 112 also controls or modulates the current through the transformer circuit 110 in response to an over-temperature sensor (OTS) signal and a power factor correction (PFC) signal. For instance, an over-temperature sensor (not shown in FIG. 1) may be adapted to generate an OTS signal indicative of whether the ambient or environment temperature exceeds a defined threshold. If the OTS signal indicates that an over-temperature condition is present, the control circuit 112 is adapted to reduce the power supplied to the luminous load 150 by, for example, reducing the current Iin through the transformer circuit 110.

The control circuit 112 is also responsive to a power factor correction (PFC) signal generated by a PFC circuit (not shown in FIG. 1). The PFC circuit generates a signal (e.g., a voltage) that is in phase with the input voltage Vin. The control circuit 112 varies the current Iin through the transformer circuit 110 in accordance with the PFC signal. This helps improve the power factor associated with supplying power to the luminous load 150 by the system 100.

Although, as discussed above, the control circuit 112 is adapted to regulate (e.g., maintain substantially constant) the power supplied to the luminous load 150 with varying input voltage Vin, the control circuit 112 is able to do this only within a defined range of Vin. If the input voltage Vin falls below the defined range, the control circuit 112 may not be able to maintain the power supplied to the luminous load 150 constant. This characteristic allows the dimmer circuit 104 to control the intensity of the light produced by the luminous load 150 by lowering the input voltage Vin below the range in which the control circuit 112 is able to maintain substantially constant power delivered to the luminous load.

The output rectifier and DC filter 114 rectifies and dc filters the voltage developed across or partially across an output winding of the transformer circuit 110 in order to generate a regulated output voltage Vout and current for the luminous load 150. Alternatively, as discussed in more detail below, the output rectifier and DC filter 114 may perform its rectifying and filtering operations based on a voltage across or partially across an input winding of the transformer circuit 110. The voltage clamp 116 protects the luminous load 150 from voltages that may spike or surge above a defined threshold level. The voltage clamp 116 performs this by shunting the load 150 when the output voltage Vout exceeds the defined threshold.

Figure 2:
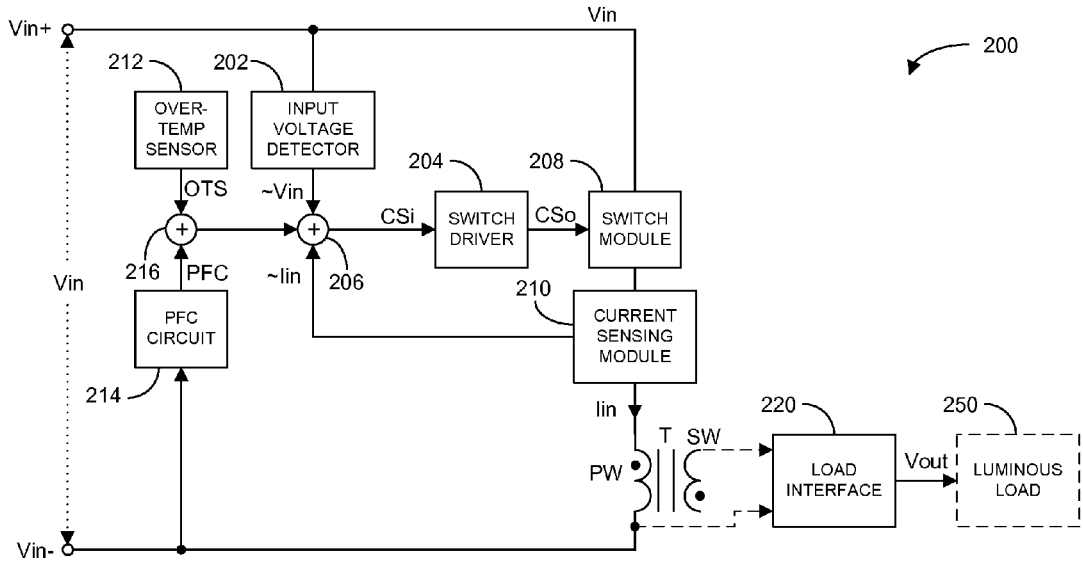
FIG. 2 illustrates a block diagram of an exemplary apparatus for supplying substantially constant power to a luminous load in accordance with another aspect of the disclosure.

FIG. 2 illustrates a block diagram of an exemplary apparatus 200 for supplying substantially constant power to a luminous load 250 in accordance with another aspect of the disclosure. The apparatus 200 comprises an input voltage detector 202, a switch driver 204, a first summing node 206, a switch module 208, a current sensing module 210, an over-temperature sensor 212, a power factor correction (PFC) circuit 214, a second summing node 216, a transformer T including a primary winding (PW) and a secondary winding (SW), and a load interface 220. The input voltage detector 202 generates a signal ~Vin that is derived from or related to an input dc voltage Vin. The current sensing module 210 generates a signal ~Iin that is derived from or related to a current flowing through the primary winding (PW) of the transformer T. The summing mode 206 combines or sums the two signals ~Vin and ~Iin to generate a component of an input signal CSi for the switch driver 204. This component is related to the power supplied to the luminous load 250.

The over-temperature sensor 212 is adapted to generate an OTS signal indicative of whether the ambient or environment temperature exceeds a defined threshold. By way of the first and second summing nodes 216 and 206, the OTS signal is also a component of the input signal CSi. The PFC circuit generates a PFC signal (e.g., a voltage) that is in phase with the input dc voltage Vin. By way of the first and second summing nodes 216 and 206, the PFC signal is also a component of the input signal CSi.

The switch driver 204 develops a control signal CSo for driving (e.g., turning ON and OFF) the switch module 208 based on the input signal CSi. As an example, the control signal CSo may be a pulse-width modulated signal cycling substantially at a center operating frequency, and modulated based on the input signal CSi. As previously discussed, the switch driver 204 may generate the control signal CSo in order to regulate the power delivered to the luminous load 250. For instance, the control signal CSo may be set or adjusted to maintain the power delivered to the luminous load 150 substantially constant for a defined range of the input voltage Vin and/or the environment temperature. As discussed above, the input parameters ~Vin and ~Iin of the input signal CSi are the dominant parameters used by the switch driver 204 in maintaining the power delivered to the load substantially constant within a defined range of the input voltage Vin and/or the environment temperature.

As previously discussed, if the input voltage Vin falls below the power regulatable range due to a dimmer circuit, the switch driver 204 generates a control signal CSo that is able to lower the power supplied to the luminous load 250 in accordance with the dimmer circuit. In a similar regard, if the over-temperature sensor 212 senses an ambient or environment temperature that exceeds a defined threshold, it generates an OTS signal that causes the switch driver 204 to generate a control voltage CSo that results in lower power supplied to the luminous load 250. This is done to protect the apparatus 200 and load 250 from damage due to excessive temperature.

As previously discussed, the PFC circuit 214 generates a PFC signal that is substantially in-phase with the phase of the input voltage Vin. In response to the PFC signal, the switch driver 204 generates a control voltage CSo that results in the current Iin through the primary winding (PW) of the transformer T vary in accordance with the phase of the input voltage Vin. This, in turn, improves the power factor associated with the delivery of power to the luminous load 250 by the apparatus 200. As an example, without the PFC circuit, the power factor associated with delivering power to the luminous load 250 may be in the range of 0.7 to 0.8. Whereas, with the PFC circuit 214, the power factor associated with delivering power to the luminous load 250 may be around 0.95.

Finally, the load interface 220 conditions (e.g., rectifies, filters, etc.) the voltage across or partially across the input winding (PW) or output winding SW of the transformer T to generate an output voltage Vout for the luminous load 250. The load interface 220 may further provide over-voltage protection for the luminous load 250.

Figure 3A:
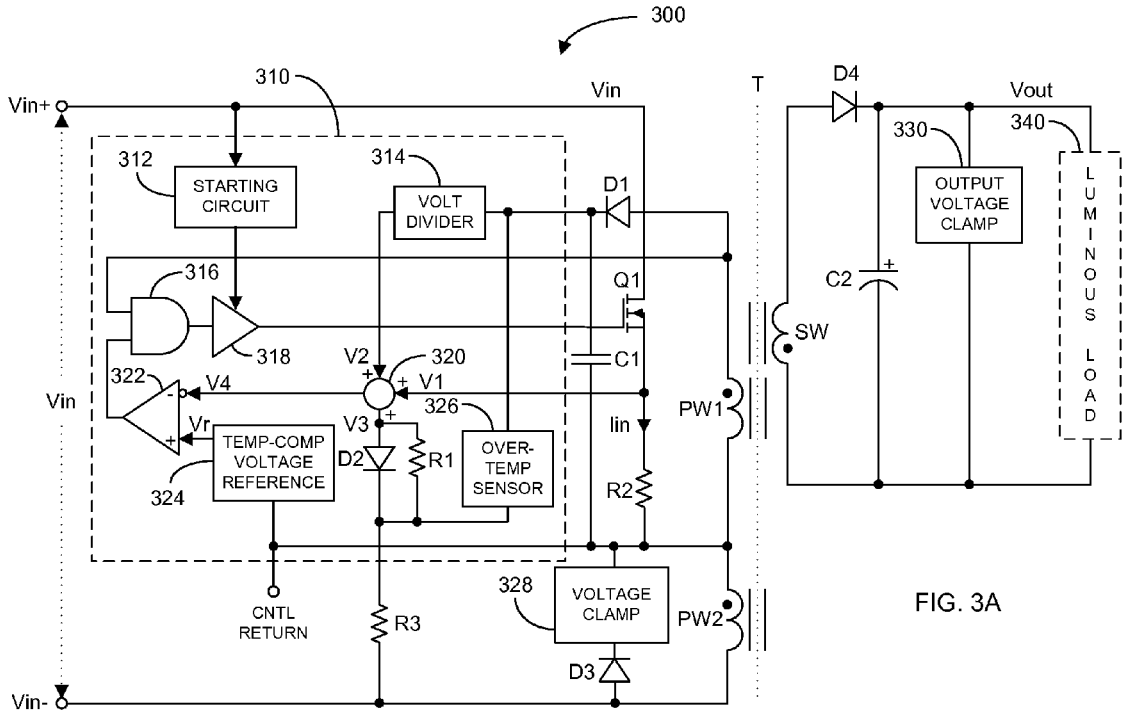
FIGS. 3A-3B respectively illustrate schematic diagrams of other exemplary apparatuses for supplying substantially constant power to a luminous load in accordance with other aspects of the disclosure.

FIG. 3A illustrates a schematic diagram of another exemplary apparatus 300 for supplying substantially constant power to a luminous load 340 in accordance with another aspect of the disclosure. The apparatus 300 comprises a control circuit 310, a first diode D1, a metal oxide semiconductor field effect transistor (MOSFET) Q1, a first capacitor C1, a current-sensing resistor R2, a transient voltage clamp 328, and a third diode D3. The control circuit 310, in turn, comprises a starting circuit 312, a voltage divider 314, an AND-gate 316, a driver 318, a comparator 322, a summing node 320, a temperature-compensated voltage reference 324, a second diode D2, a resistor R1, and an over-temperature sensor 326. The apparatus 300 additionally comprises a transformer T including first and second primary windings PW1-2 and secondary winding SW, a fourth diode D4, a second capacitor C2, and an output voltage clamp 330.

The starting circuit 312 is adapted to generate a starting current in response to detecting the input voltage Vin so that the driver 318 generates a signal adapted to turn ON the MOSFET Q1. This produces a current Iin to flow from the positive input voltage terminal Vin+ through the MOSFET Q1, the current-sensing resistor R2, and the second primary winding PW2 of the transformer T, to the negative input voltage terminal Vin−. This causes energy to be stored in the primary winding PW2 of the transformer T. In response to the transformer current, a voltage V1 develops across the current-sensing resistor R2 that is related (e.g., proportional) to the transformer current Iin. Additionally, a voltage develops at an upper end of the first primary winding PW1 of the transformer T that is related to the input voltage Vin. Through the diode D2, this voltage is stored by the capacitor C1, and then scaled by the voltage divider 314 in order to generate a voltage V2. At the summing node 320, the voltages V1 and V2 are combined to generate a voltage V4. The V1 and V2 components of the voltage V4 is related to the power delivered to the luminous load 340 for a defined range of the input voltage Vin.

The over temperature sensor 326 is adapted to generate a voltage from the voltage at the cathode of the diode D1 if the ambient or environment temperature associated with the apparatus 300 exceeds a defined threshold. Additionally, the second diode D2 and resistor R3 are adapted to develop a voltage at the anode of the second diode D2 that has a phase substantially the same as the phase of the input voltage Vin. Accordingly, the second diode D2 and resistor R3 serve as a power factor correction (PFC) circuit that injects an in-phase signal into the voltage V4.

Under normal (e.g., non-over-temperature) condition, the voltage V4 at the output of the summing node 320 includes the component V1/V2, which is related to the power being delivered to the luminous load 340, and includes the component V3, which is a voltage that is substantially in-phase with the input voltage Vin. The voltage V4 is applied to the negative input of the comparator 322, and a reference voltage Vr generated by the temperature-compensated voltage reference 324 is applied to the positive input of the comparator. Initially or upon start-up, the output of the comparator 322 is at a high logic level due to the voltage V4 being lower than the reference voltage Vr. Due to the rising transformer current (V1) and the transformer voltage (V2), the voltage V4 rises above the reference voltage Vr. When this occurs, the comparator 322 generates a low logic level. As a consequence, the AND-gate 316 produces a low logic level, which the driver 318 outputs to cause the MOSFET Q1 to turn OFF. When this occurs, the windings of the transformer T reverse its voltage polarity (commonly referred to as a fly-back action).

During this time, energy stored in the first primary winding PW1 of the transformer T is released to the luminous load 340 by way of the secondary winding SW of the transformer T. Once all of the energy in the primary winding PW1 of the transformer T is released, the voltages on windings PW1-2 and SW reverse again, and allow the MOSFET Q1 to turn ON again. This process continuously repeats causing the MOSFET Q1 to turn ON and OFF, and sustain its self oscillation at a particular or defined frequency. The duty cycle or pulse width of the signal driving the MOSFET Q1 is modulated by the voltage V4, which includes the voltages V1 and V2, which, as discussed above, is related to the power delivered to the luminous load 340. The comparison of the voltage V4 to the temperature-compensated reference voltage Vr causes the signal driving the MOSFET Q1 to regulate or maintain the power delivered to the luminous load 340 substantially constant within a specific or defined range of the input voltage Vin and temperature.

As previously discussed, the component V3 of the voltage V4 has a phase substantially the same as the input voltage Vin. Accordingly, the voltage V4 has a component in-phase with the input voltage Vin. Through the operations of the comparator 322, AND-gate 316, driver 318 and MOSFET Q1, the current Iin through the primary winding PW2 of the transformer T will also have a component in-phase with the input voltage Vin. This improves the power factor associated with the delivery of power to the luminous load 340, which is desirable from the standpoint of the utility company supplying the ac power to the apparatus 300.

As previously discussed, the over temperature sensor 326 generates a voltage if the ambient or environment temperature exceeds a defined threshold. During such over temperature condition, this voltage, which is applied to the summing device 320 by way of resistor R1, increases the voltage V4. Through the operations of the comparator 322, AND-gate 316, driver 318 and MOSFET Q1, the current Iin through the primary winding PW2 of the transformer T tends to decrease when the voltage V3 increases due to the over temperature sensor 326. Accordingly, the power delivered to the luminous load 340 is reduced when the over temperature sensor 326 detects an over temperature condition. This protects the apparatus 300 and load 340 from damage due to excessive temperature.

The fourth diode D4, second capacitor C2 and output voltage clamp 330, in this example, make up the load interface circuit. More specifically, the fourth diode D4 rectifies the alternating energy released from the transformer T, and the second capacitor C2 filters the rectified energy to generate an output voltage Vout across the luminous load 340.

In any non-normal operating condition that causes the output voltage Vout across the luminous load 340 to exceed a defined level, the output voltage clamp 330 activates and shunts the load. This reduces the power delivered to the load in order to prevent damage to the load and the apparatus 300. Additionally, the transient voltage clamp 328 is coupled in series with the third diode D3 to clamp leakage energy from the first primary winding PW1 of the transformer T to prevent excessive voltage present to the MOSFET Q1 when it is turned OFF. This clamp circuit 328 may contain transient voltage suppressor or other resistor, capacitor or combination thereof to achieve the voltage clamping function.

The control circuit 310 may also be configured to be insensitive to adjustment of the input voltage Vin due to it being controlled by a phase control dimmer circuit. As previously discussed, a phase control dimmer circuit suppresses or cuts-out a portion of the input rectified waveform Vin. If the portion of the input rectified waveform being suppressed is less than a half period or 180 degrees of the waveform, the peak of the input waveform is not affected. However, the received power or integration of the rectified waveform varies as a function of the waveform suppression. If the voltage V2 is configured to vary only as a function of the peak voltage of the input rectified voltage Vin, then the dimmer circuit is able to reduce the power delivered to the luminous load without the control circuit 310 reacting to the reduced power. Thus, the apparatus 300 is able to adequately interface a dimmer circuit to the luminous load 340, and at the same time maintain constant power to the load during normal or non-dimming operations.

Figure 3B:
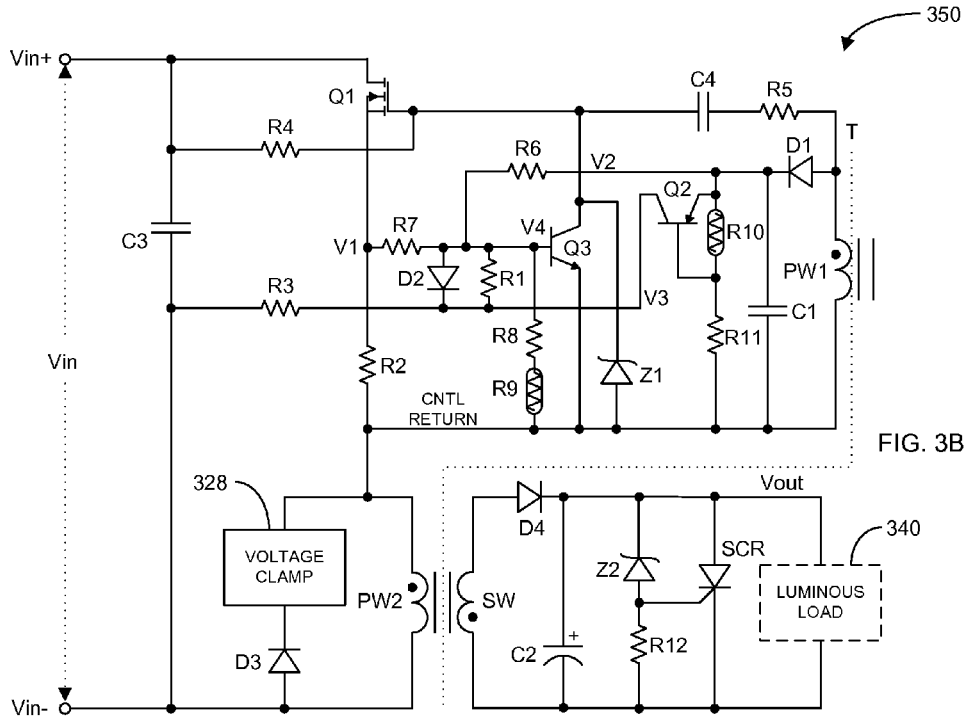

FIG. 3B illustrates a schematic diagram of an exemplary apparatus 350 for supplying substantially constant power to a luminous load 340 in accordance with another aspect of the disclosure. The apparatus 350 may be a more detailed implementation of the apparatus 300 previously discussed. Elements in apparatus 350 that perform similar operations as elements in apparatus 300 are identified with the same reference numbers and labels.

More specifically, the apparatus 350 comprises the transient voltage clamp 328 and a third diode D3 to clamp leakage energy from a second primary winding PW2 of the transformer T to prevent excessive voltage present to a MOSFET Q1 when it is turned OFF. The capacitor C3 and resistor R4, in combination, operate similar to the starting circuit 312, discussed above, to turn ON the MOSFET Q1 upon start-up. That is, upon start-up, the voltage across the capacitor C3 begins to rise. The voltage across the capacitor C3 is coupled to the gate of the MOSFET Q1 via the resistor R4. Once the voltage crosses the threshold of MOSFET Q1, the device turns ON allowing a current to flow through the second primary winding PW2 of the transformer T. The resistor R2 operates to generate a voltage V1 that is related to the current flowing through the second primary winding PW2 of the transformer T.

The first diode D1 and capacitor C1 produce a voltage V2 by sampling and holding the voltage across the first primary winding PW1 of the transformer T, which is proportional to the input voltage Vin. The resistors R6 and R7 operate as the voltage divider 314. A second bipolar transistor Q2, positive temperature coefficient thermistor R10 and resistor R11 operate as the over-temperature sensor. That is, when the ambient or environment temperature exceeds the trigger temperature of thermistor R10, the resistance of the resistor R10 increases substantially. As a result, the voltage at the base of transistor Q2 decreases. When the difference between the emitter and base voltages exceeds the threshold voltage of the transistor Q2, the transistor conducts causing the voltage V3 to increase and reduce the duty cycle associated with operating the MOSFET Q1. The second diode D2 and resistor R3 operate as the power factor correction (PFC) circuit to generate a voltage V3 that is substantially in phase with the input voltage Vin. The voltages V1-V3 are applied to the base of bipolar transistor Q3 by way of respective resistors R7, R6 and R1 to form the voltage V4.

The resistor R8 and thermistor R9 in conjunction with the base-emitter voltage Vbe of the bipolar-junction transistor (BJT) Q3 operate as the temperature-compensated voltage reference 324 discussed above. The BJT Q3 in conjunction with the second Zener diode Z1, capacitor C4 and resistor R5 operate as the AND-gate 316 and driver 318 discussed above.

The fourth diode D4 operate to rectify the alternating voltage received from the secondary winding SW of the transformer T. The second capacitor C2 operates to filter the rectified voltage to generate the output voltage Vout for the luminous load 340. A second Zener Z2 in conjunction with resistor R12 and silicon-controlled rectifier (SCR) operate as the output voltage clamp 330 discussed above to protect the luminous load 340 from harmful voltage levels.

Figure 4A:
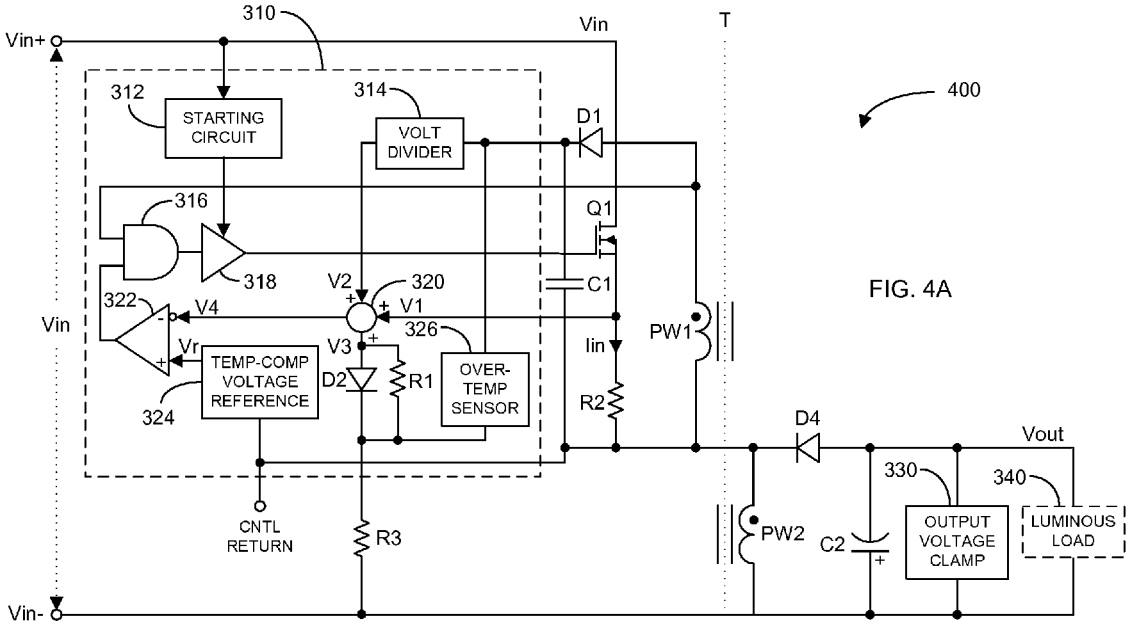
FIGS. 4A-4B respectively illustrate schematic diagrams of other exemplary apparatuses for supplying substantially constant power to a luminous load in accordance with other aspects of the disclosure.

FIG. 4A illustrates a schematic diagram of another exemplary apparatus 400 for supplying substantially constant power to a luminous load 340 in accordance with another aspect of the disclosure. The apparatus 400 is similar to apparatus 300 and includes many of the same elements as denoted with the same reference numbers and labels. Accordingly, the operation of these common elements have been discussed in detail above. The apparatus 400 differs from apparatus 300 in that the load interface circuit is coupled across the second primary winding PW2 of the transformer T, instead of the secondary winding SW as in the apparatus 300. It shall be understood that the load interface circuit may be coupled to the transformer T in many distinct manners.

Figure 4B:
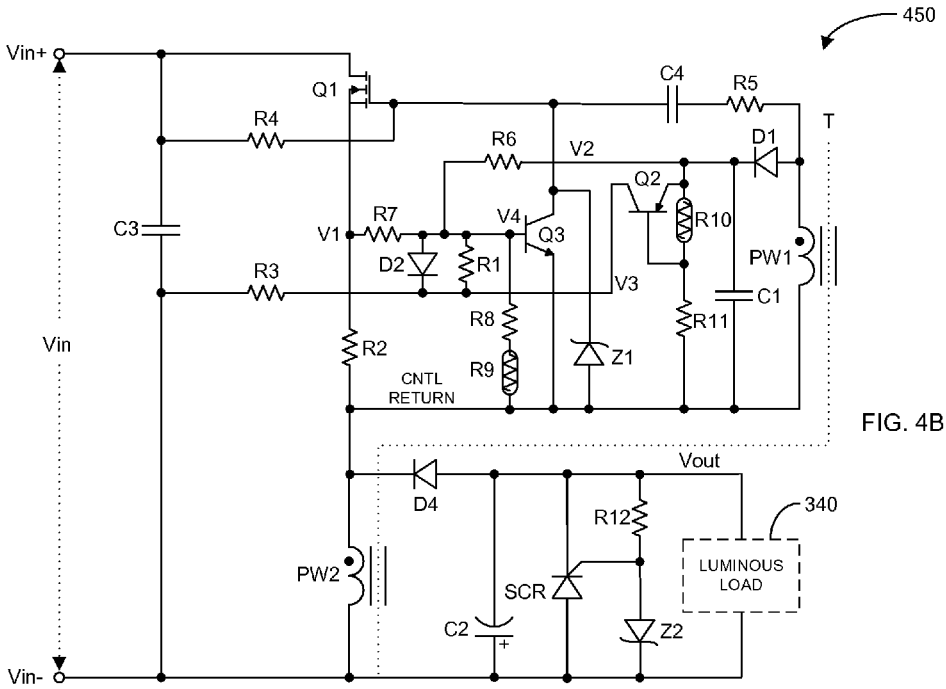

FIG. 4B illustrates a schematic diagram of another exemplary apparatus 450 for supplying substantially constant power to a luminous load 340 in accordance with another aspect of the disclosure. The apparatus 450 is similar to apparatus 350 and includes many of the same elements as denoted with the same reference numbers and labels. Accordingly, the operation of these common elements have been discussed in detail above. The apparatus 450 differs from apparatus 350 in that the load interface circuit is coupled across the second primary winding PW2 of the transformer T, instead of the secondary winding SW as in the apparatus 350. It shall be understood that the load interface circuit may be coupled to the transformer T in many distinct manners.

Figure 5A:
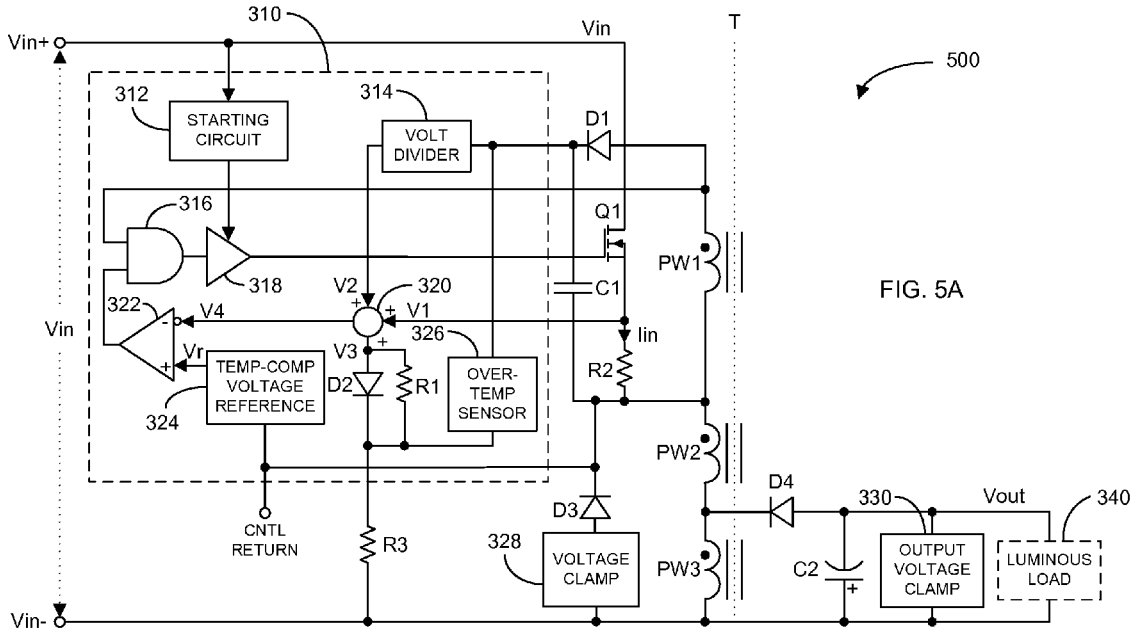
FIGS. 5A-5B respectively illustrate schematic diagrams of other exemplary apparatuses for supplying substantially constant power to a luminous load in accordance with other aspects of the disclosure.

FIG. 5A illustrates a schematic diagram of another exemplary apparatus 500 for supplying substantially constant power to a luminous load 340 in accordance with another aspect of the disclosure. The apparatus 500 is similar to apparatus 400, and includes many of the same elements as denoted with the same reference numbers and labels. Accordingly, the operation of these common elements have been discussed in detail above. The apparatus 500 differs from apparatus 400 in that the load interface circuit is coupled between the second primary winding PW2 and a third primary winding PW3 of the transformer T. It shall be understood that the load interface circuit may be coupled to the transformer T in many distinct manners.

Figure 5B:
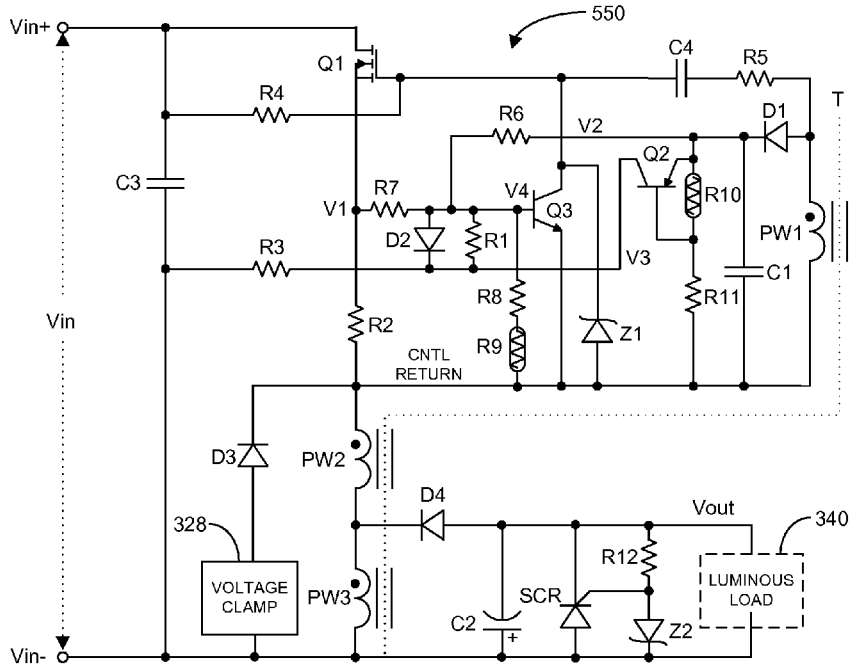

FIG. 5B illustrates a schematic diagram of another exemplary apparatus 550 for supplying substantially constant power to a luminous load 340 in accordance with another embodiment of the invention. The apparatus 550 is similar to apparatus 450 and includes many of the same elements as denoted with the same reference numbers and labels. Accordingly, the operation of these common elements have been discussed in detail above. The apparatus 550 differs from apparatus 450 in that the load interface circuit is coupled between the second primary winding PW2 and a third primary winding PW3 of the transformer T. It shall be understood that the load interface circuit may be coupled to the transformer T in many distinct manners.

Figure 6A:
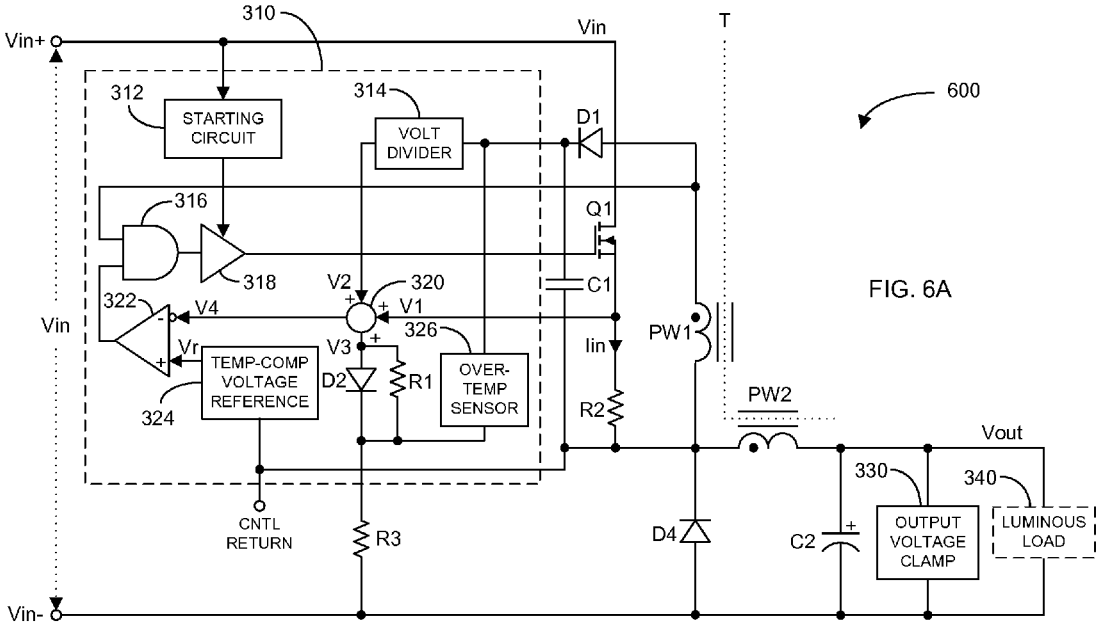
FIGS. 6A-6B respectively illustrate schematic diagrams of other exemplary apparatuses for supplying substantially constant power to a luminous load in accordance with other aspects of the disclosure.

FIG. 6A illustrates a schematic diagram of another exemplary apparatus 600 for supplying substantially constant power to a luminous load 340 in accordance with another aspect of the disclosure. The apparatus 600 is similar to apparatus 300, and includes many of the same elements as denoted with the same reference numbers and labels. Accordingly, the operation of these common elements have been discussed in detail above. The apparatus 600 differs from apparatus 300 in that the fourth diode D4 of the load interface circuit is coupled between the first and second primary windings PW1-2 of the transformer T and the Vin− terminal, and the remaining portion of the load interface circuit is coupled in series with the first and second primary windings PW1-2. It shall be understood that the load interface circuit may be coupled to the transformer T in many distinct manners.

Figure 6B:
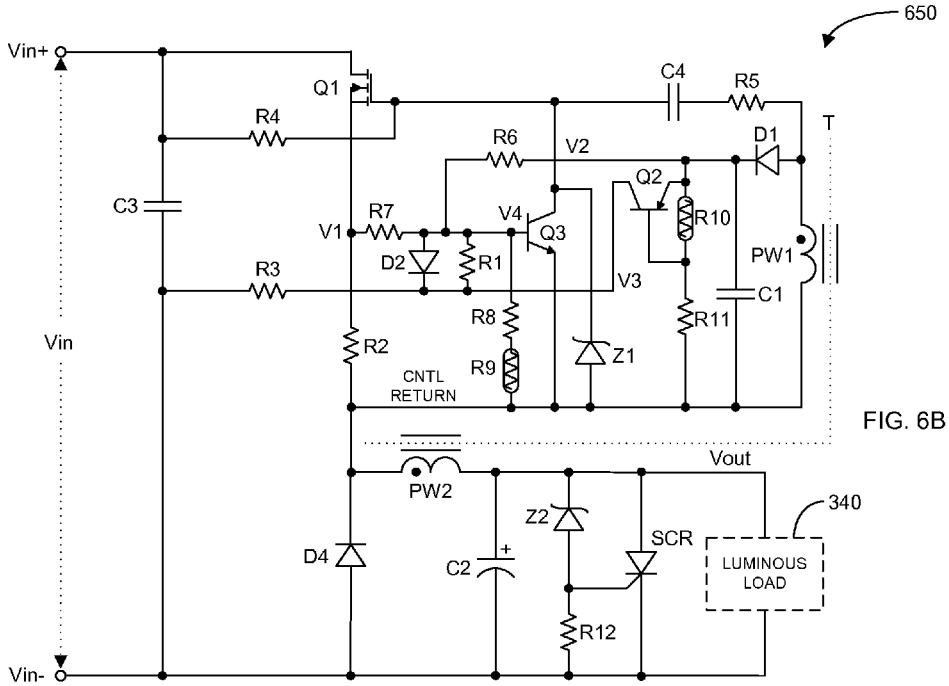

FIG. 6B illustrates a schematic diagram of another exemplary apparatus 650 for supplying substantially constant power to a luminous load 340 in accordance with another aspect of the disclosure. The apparatus 650 is similar to apparatus 350, and includes many of the same elements as denoted with the same reference numbers and labels. Accordingly, the operation of these common elements have been discussed in detail above. The apparatus 650 differs from apparatus 350 in that the fourth diode D4 of the load interface circuit is coupled between the first and second primary windings PW1-2 of the transformer T and the Vin− terminal, and the remaining portion of the load interface circuit is coupled in series with the first and second primary windings PW1-2. It shall be understood that the load interface circuit may be coupled to the transformer T in many distinct manners.

Figure 7A:
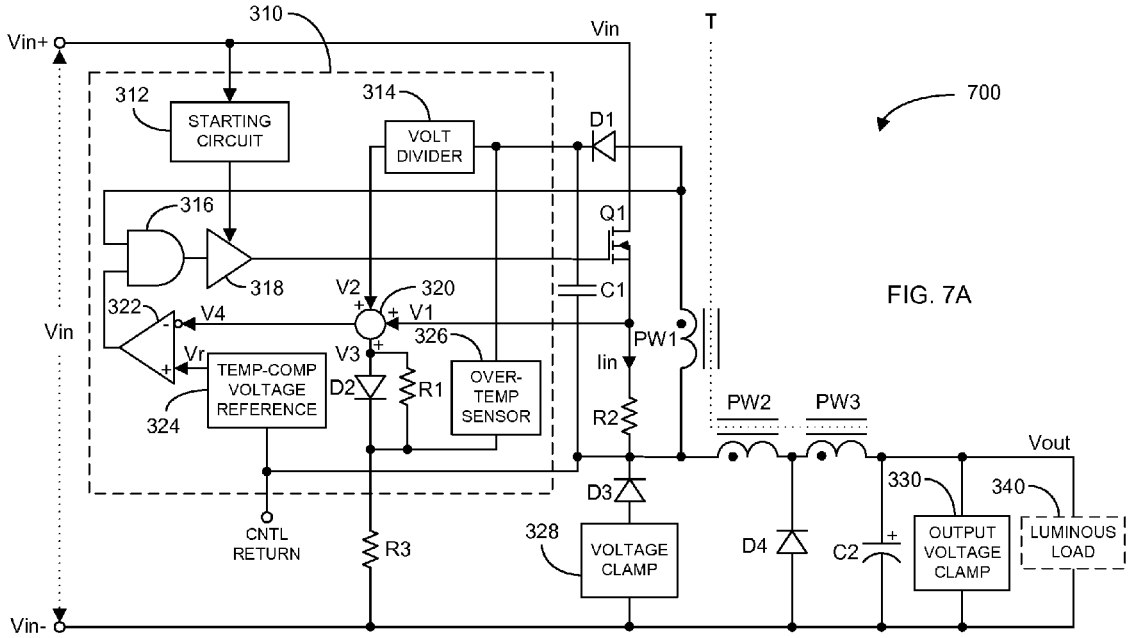
FIGS. 7A-7B respectively illustrate schematic diagrams of other exemplary apparatuses for supplying substantially constant power to a luminous load in accordance with other aspects of the disclosure.

FIG. 7A illustrates a schematic diagram of another exemplary apparatus 700 for supplying substantially constant power to a luminous load 340 in accordance with another aspect of the disclosure. The apparatus 700 is similar to apparatus 600 and includes many of the same elements as denoted with the same reference numbers and labels. Accordingly, the operation of these common elements have been discussed in detail above. The apparatus 700 differs from apparatus 300 in that the fourth diode D4 of the load interface circuit is coupled between the second and third primary windings PW2-3 of the transformer T and the Vin− terminal, and the remaining portion of the load interface circuit is coupled in series with the first, second, and third primary windings PW1-3. It shall be understood that the load interface circuit may be coupled to the transformer T in many distinct manners.

Figure 7B:
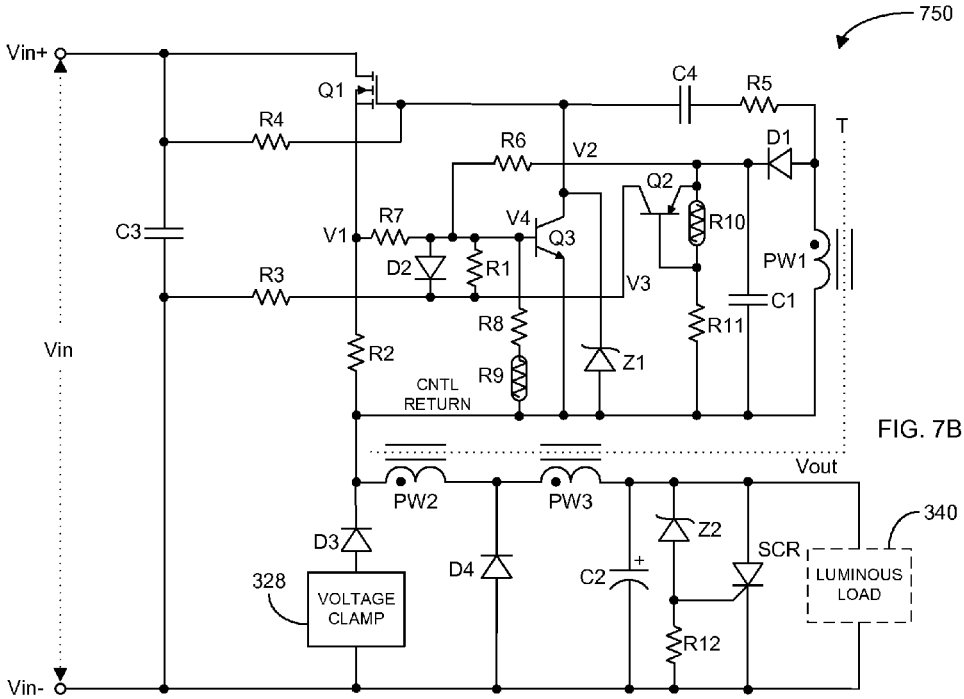

FIG. 7B illustrates a schematic diagram of another exemplary apparatus 750 for supplying substantially constant power to a luminous load 340 in accordance with another aspect of the disclosure. The apparatus 750 is similar to apparatus 350 and includes many of the same elements as denoted with the same reference numbers and labels. Accordingly, the operation of these common elements have been discussed in detail above. The apparatus 750 differs from apparatus 350 in that the fourth diode D4 of the load interface circuit is coupled between the second and third primary windings PW2-3 of the transformer T and the Vin− terminal, and the remaining portion of the load interface circuit is coupled in series with the first, second, and third primary windings PW1-3. It shall be understood that the load interface circuit may be coupled to the transformer T in many distinct manners.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An apparatus for supplying power to a luminous load, comprising:

a transformer including a first primary winding adapted to receive an input voltage; and a control circuit adapted to generate an alternating current through the first primary winding based on a first signal derived from the input voltage, a second signal derived from the current, and a third signal varying substantially in-phase with the input voltage, wherein the transformer is adapted to develop an alternating voltage across the first primary winding based on the alternating current; and a load interface circuit adapted to generate an output voltage for the luminous load based on the alternating voltage from the transformer.

2. The apparatus of claim 1, wherein the control circuit is adapted to generate the alternating current to deliver substantially constant power to the luminous load in response to variation in the input voltage.

3. The apparatus of claim 1, wherein the control circuit is adapted to generate the alternating current to deliver substantially constant power to the luminous load in response to variation in an environment temperature.

4. The apparatus of claim 1, wherein the control circuit is adapted to vary the power supplied to the luminous load in response to changes in the input voltage caused by a dimmer circuit.

5. The apparatus of claim 1, wherein the first signal varies only as a function of a peak amplitude of the input voltage.

6. The apparatus of claim 1, wherein the control circuit comprises a summing node adapted to generate a fourth signal from the first, second and third signals, wherein the control circuit is adapted to generate the alternating current based on the fourth signal.

7. The apparatus of claim 6, wherein the control circuit further comprises:

a source of a temperature-compensated reference signal; and a comparator adapted to generate a fifth signal based on a comparison of the temperature-compensated reference signal and the fourth signal;

wherein the control circuit is adapted to generate the alternating current based on the fifth signal.

8. The apparatus of claim 7, wherein the control circuit further comprises a logic gate device adapted to generate a sixth signal based on the fifth signal, wherein the control circuit is adapted to generate the alternating current based on the sixth signal.

9. The apparatus of claim 1, wherein the transformer comprises a second primary winding, and wherein the first signal is derived from a voltage across the second primary winding.

10. The apparatus of claim 1, wherein the first signal is derived directly from the input voltage.

11. The apparatus of claim 1, further comprising a power factor correction (PFC) circuit adapted to generate the third signal.

12. The apparatus of claim 1, further comprising an over-temperature sensor adapted to generate a fourth signal indicative of whether an ambient or environment temperature exceeds a threshold, wherein the control circuit is adapted to generate the alternating current based on the fourth signal.

13. The apparatus of claim 1, wherein the load interface circuit is adapted to receive the alternating voltage directly from at least a portion of the first primary winding.

14. The apparatus of claim 1, wherein the transformer comprises a secondary winding, and wherein the load interface circuit is adapted to receive the alternating voltage from at least a portion of the secondary winding.

15. The apparatus of claim 1, wherein the load interface circuit comprises:

a rectifier adapted to rectify the alternating voltage; and a capacitive element adapted to filter the rectified voltage to generate the output voltage for the luminous load.

16. The apparatus of claim 15, wherein the load interface circuit further comprises an output clamp circuit adapted to at least partially shunt the luminous load if the output voltage exceeds a threshold.

17. The apparatus of claim 1, further comprising a transient voltage clamp circuit adapted to absorb leakage current from the first primary winding of the transformer.

18. The apparatus of claim 1, wherein the luminous load comprises a light emitting diode (LED)-based load, an incandescent-based load, or a fluorescent-based load.

19. A method for supplying power to a luminous load, comprising:

generating an alternating current through a primary winding of a transformer based on a first signal derived from an input voltage, a second signal derived from the current, and a third signal varying substantially in-phase with the input voltage;

generating an alternating voltage across the primary winding of the transformer in response to the alternating current; and generating an output voltage for the luminous load based on the alternating voltage from the transformer.

20. The method of claim 19, wherein generating the alternating current comprises generating the alternating current in a manner that substantially constant power is delivered to the luminous load in response to variation in the input voltage or environment temperature.

21. The method of claim 19, generating the alternating current comprises generating the alternating current in a manner that varies the power supplied to the luminous load in response to changes in the input voltage caused by a dimmer circuit.

22. The method of claim 19, further comprising generating a fourth signal indicative of whether an ambient or environment temperature exceeds a threshold, wherein generating the alternating current is further based on the fourth signal.

23. An apparatus for controlling power to a luminous load, comprising a control circuit adapted to generate an alternating current through a first primary winding of a transformer based on a first signal derived from an input voltage, a second signal derived from the current, and a third signal varying substantially in-phase with the input voltage, wherein the transformer is adapted to deliver power to the luminous load based on the alternating current.

24. The apparatus of claim 23, further comprising an over-temperature sensor adapted to generate a fourth signal indicative of whether an ambient or environment temperature exceeds a threshold, wherein the control circuit is adapted to generate the alternating current based on the fourth signal.

* * * * *